United States Patent [19]

Swaim

[11] 4,285,096

[45] Aug. 25, 1981

[54] INDESTRUCTIBLE HANDLE FOR MOP OR BROOM AND METHOD OF MAKING SAME

[75] Inventor: Martin H. Swaim, Wyoming, Mich.

[73] Assignee: Theron A. Van Putten, Grand Rapids, Mich.

[21] Appl. No.: 947,617

[22] Filed: Oct. 2, 1978

[51] Int. Cl.[3] ..... A47B 95/02

[52] U.S. Cl. ..... 16/114 R; 15/145; 403/3

[58] Field of Search ..... 403/299, 343, 3, 296, 403/266, 267, 274; 16/114 R, 110 R; 15/145; 228/136; 29/516, 517

[56] References Cited

U.S. PATENT DOCUMENTS

| | | | |
|---|---|---|---|
| 1,762,572 | 6/1930 | Davidson | 403/343 |
| 2,039,899 | 5/1936 | Hargrave | 403/343 X |
| 2,237,969 | 4/1941 | Olsen | 15/143 R |
| 2,950,015 | 8/1960 | Pataky | 403/267 X |
| 3,789,562 | 2/1974 | De Chicchis et al. | 403/3 X |

FOREIGN PATENT DOCUMENTS

| | | | |
|---|---|---|---|
| 289353 | 4/1928 | United Kingdom | 29/175 R |
| 586302 | 3/1947 | United Kingdom | 15/145 |

*Primary Examiner*—Andrew V. Kundrat
*Attorney, Agent, or Firm*—Waters & Lesniak

[57] ABSTRACT

An indestructible handle for a mop or broom or the like comprises a tubular steel handle member with a solid steel plug mounted in the end thereof and protruding out of the end. The exterior of the steel plug is provided with a modified Acme thread that fits a standard thread on a push broom. The outer end of the steel plug includes a threaded opening such that it can fit on a threaded handle attachment stud on a mop frame. A plastic sleeve encases the handle member. The steel plug is mounted in the end of the handle member by crimping the handle member over the portion of the plug extending into the handle member at three equally spaced points around the handle. The threads on the plug extend into the handle, and crimping tools having a plurality of pointed projections thereon at each of the three crimping positions crimp the tubular member so that the tube is crimped inwardly between the threads of the plug, thus holding the plug in the end of the tubular member. The tubular member is then spot welded to the plug at the three crimping positions.

9 Claims, 5 Drawing Figures

INDESTRUCTIBLE HANDLE FOR MOP OR BROOM AND METHOD OF MAKING SAME

BACKGROUND OF THE INVENTION

1. Field of the Invention

This invention relates to an indestructible handle for a broom or mop or the like and a method for making same, and more particularly to a handle comprising a tubular steel handle member having a solid steel plug mounted in the end thereof, with the plug having external and internal threads for mounting the handle on different types of utility implements.

2. Description of the Prior Art

Since time immemorial it seems that broom handles have been made of wood with wooden threads formed in the lower end thereof, and since time immemorial it seems that such handles have been prone to frequent breakage. Such handles are quite expensive and breakage is a serious problem. In addition, breakage of a handle almost always occurs at the threads, leaving the threaded end embedded in the thread openings in the broom head. This makes it difficult to remove the threads before the head can be threaded with a new handle.

In an attempt to overcome this problem, a number of sophisticated and expensive metal brace members have been developed in order to minimize the sideways strain on a handle at the point where the handle is threaded into the broom head. Typically such a brace comprises metal struts extending at an angle from the broom handle to the broom head. Braces of this nature are widely used in industrial applications where a single individual operating a broom can break several expensive broom handles in a single day. Braces are expensive and cumbersome units and are not completely effective in overcoming the problems of broom handle breakage. Nonetheless, braces seem to have been the only structure available prior to the present invention for prolonging the life of a broom handle.

Other attempts have been made to prolong the life of a broom handle by providing metal threads at the end of a wooden broom handle. Typically, such a construction comprises a molded aluminum fitting that fits over the end of a handle, with the fitting including a stud portion having threads adapted to fit in a broom head. A rivet or screw may be employed to hold the fitting on the end of a broom handle.

The problem with this construction is that the stress on the broom handle is then placed at the junction between the broom handle on the outer edge of the fitting receptacle. Further, the means by which the fitting is attached to the broom handle is somewhat unsatisfactory and tends to loosen and break after a period of time.

Another problem with prior handle constructions is that a handle used for a broom can not be used for a mop or similar implement wherein the mop is attached to the handle by means of a threaded stud on the mop that is received in a threaded opening in the handle. Thus, two handles have to be used for the two types of implements and separate quantities of handles of each type have to be inventoried by a maintenance supervisor.

The present invention overcomes the foregoing problems with prior art handles and provides an indestructible broom handle capable of use interchangeably with a broom head or a mop frame.

SUMMARY OF THE INVENTION

In accordance with the present invention, a handle for a push broom or mop or the like comprises an elongated metal tubular handle member having an open outer end and a cylindrical metal plug mounted rigidly in the open outer end of the handle member. The metal plug includes external threads that are shaped so as to fit the internal threads of a standard push broom head. The metal plug also has a threaded internal opening in the outer end thereof, such that the internally threaded opening fits an externally threaded mounting stud on the standard mop head.

The handle member is formed of tubular steel and the plug is likewise formed of tubular steel. To avoid the necessity for close manufacturing and fitting tolerances, the diameter of the plug is slightly less than the inner diameter of the tube. The tube is mounted on the plug by crimping the tube on the plug at a plurality of locations around the tube, with the tube being spot welded to the plug at the points where the tube is crimped on the plug.

The plug includes a recessed portion (an extended portion of the external threads) positioned inside the tube, and the tube is crimped on the plug by means of a crimping tool employing external projections that deform the tube inwardly between the threads of the plug. Such crimping serves to mechanically hold the plug in the tube until the two members can be welded together.

A method for manufacturing the foregoing handle comprises forming external threads on the plug a sufficient distance such that the threaded portion of the plug fits partially into the interior of the tube, crimping the end of the handle over the plug at a plurality of positions around the handle with a crimping tool having projections that deform the wall of the tube inwardly between the threads of the plug as the tube is pressed against the plug, and thereafter spot welding the tube to the plug at the points where the tube is crimped into contact with the plug.

The present invention provides a simple and inexpensive handle that overcomes long standing serious deficiencies with prior handles. The handle of the present invention is virtually indestructible and will not break or bend under any reasonable conditions of normal use. Further, the handle is adaptable to a number of different types of implements, such as a push broom (wherein a handle having external Acme type threads is required) or a metal mop frame wherein an internal opening adapted to fit over a threaded stud is required. The handle can also be used in connection with a paint roller or similar implement. A vinyl sleeve on the external surface of the handle provides a protective gripping surface for the handle.

These and other features and advantages of the present invention will hereinafter appear. For purposes of illustration, but not of limitation; a preferred embodiment of the present invention is described below and shown in the appended drawings.

DETAILED DESCRIPTION OF THE PREFERRED EMBODIMENT

Figure 1:
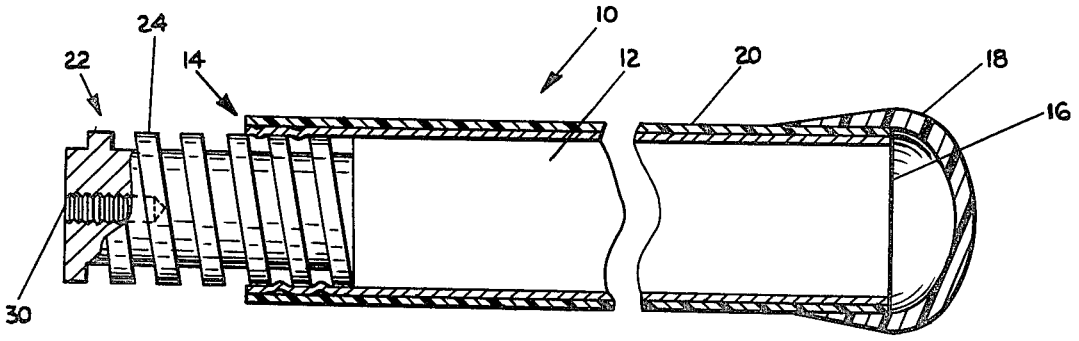
FIG. 1 is a side cross-section view of the handle of the present invention.

Referring now to the drawings, handle 10 of the present invention comprises an elongated tubular metal handle member 12 having an open outer end 14 and an inner end 16 that is enclosed by a plastic cap 18. A vinyl sleeve 20 encases the full length of the tube.

Tube 12 is formed of 20 gauge welded steel tube having a 13/16 inch outer diameter. The inner diameter of this tube is approximately 0.756 inches.

A plug 22 is inserted in the outer end of tubular handle member 12. Plug 22 is formed of steel and preferably has an outer diameter of approximately 0.750 inches. The external surface of plug 22 is provided with a modified Acme thread 24 that is shaped so as to fit in a conventional internally threaded opening 26 in a conventional push broom 28. The modified Acme thread of the present invention has about five and one-half ($5\frac{1}{2}$) threads per inch with a thread being approximately 0.175–0.200 inches. Each thread has a thickness of approximately 0.088 inches. The threads are formed the entire length of the two inch plug.

The outer end of plug 22 is provided with an internally threaded opening 30 that is adapted to fit on a threaded attachment stud 32 of a conventional metal mop frame 34. Hole 30 is approximately 5/16ths in diameter and has approximately eighteen (18) threads per inch. This size of hole is sufficient to attach the handle to most conventional mops employing a threaded attachment stud.

Figure 2:
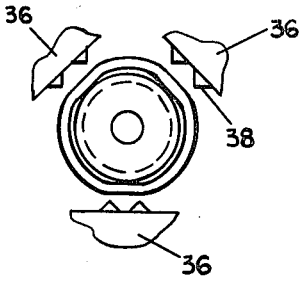
FIG. 2 is an end view of the present invention showing how the tube is crimped on the plug.
Figure 3:
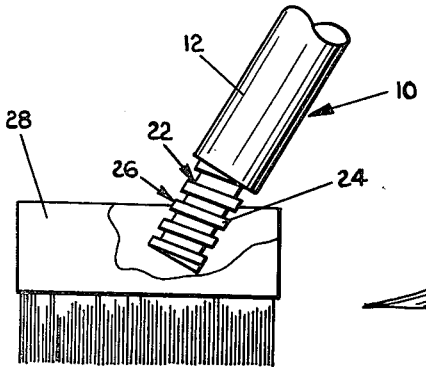
FIG. 3 is a partially broken side elevational view showing the end of the handle threaded into a conventional push broom.
Figure 4:
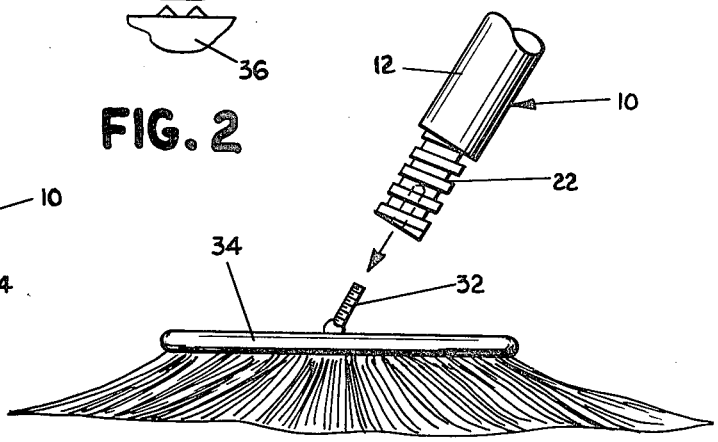
FIG. 4 is a partially broken side elevational view showing the manner in which the handle of the present invention Is attachd to a mop having a threaded handle attachment stud thereon.

Handle 12 is attached to plug 22 in the following manner: Plug 22 is first inserted part way into the handle. The handle is then crimped downwardly onto the plug at three (3) equally spaced locations around the tube (as shown in FIG. 2). For this purpose, a crimping tool 36 is employed at each crimping location, with each crimping tool including a plurality of diamond-shaped projections 38 that engage and grip the outer surface of the tube as the crimping is performed. The diamond-shaped projections are randomly spaced on the surface of the crimping tool such that one or more diamond-shaped projections engages the tube at a position between the threads of the stud. This engagement causes the diamond-shaped projections to deform the wall of the tube inwardly between the threads of the stud. The inwardly deformed wall thus holds the plug in position in the end of the tube until the tube and plug can be welded together in a spot welding machine, which is the final step in the process. The tube is welded to the plug at the points of contact between the tube and the plug.

By using the foregoing method of attaching the tube to the plug, it is not necessary to maintain extremely high tolerances between the outside diameter of the plug and the internal diameter of the tube. It also makes it easier for the plug to be fitted into the end of the tube. The crimping method thus makes it less expensive for the manufacture of the handle of the present invention.

Figure 5:
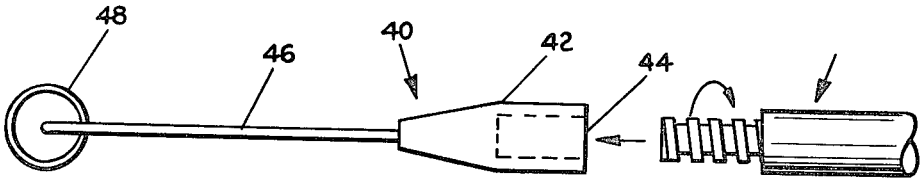
FIG. 5 is a partially broken side elevational view showing the manner in which the handle of the present invention is employed in connection with a paint roller.

The use of handle 10 in connection with a paint roller 40 is shown in FIG. 5. Paint roller 40 includes a handle 42 having an internally threaded opening 14 of substantially the same configuration as opening 26 in push broom 28. A shaft 46 extends outwardly from handle 42 and a paint roller 48 is rotatably mounted on the end of the shaft.

It should be understood that various modifications may be made in the arrangements and details of construction of the present invention without departing from the spirit and scope of the present invention.

The embodiments of the invention in which an exclusive property or privilege is claimed are defined as follows:

1. A durable handle for a push broom or mop or the like comprising:

an elongated tubular handle member formed of weldable metal having an open outer end; and a cylindrical plug formed of weldable metal mounted rigidly in the open outer end of the handle member, the metal plug including external threads that are shaped so as to fit the internal threads of a standard push broom head, the metal plug further having a threaded internal opening in the outer end thereof such that the internally threaded opening fits an externally threaded mounting stud on a standard mop head, the plug being spot welded in the end of the tube.

2. A handle according to claim 1 wherein the diameter of the plug is slightly less than the inner diameter of the tube and the tube is crimped on the plug so as to provide surface contact for spot welding.

3. A handle according to claim 2 wherein the plug includes a recessed portion inside the tubular handle member and the tube is crimped into the recessed portion so as to mechanically hold the plug in the handle member.

4. A handle according to claim 3 wherein the external threads on the plug extend into the interior of the tube and form the recessed portion of the plug, the tube being crimped on the plug such that the tube is deformed inwardly between the threads of the plug, such crimping serving to hold the plug in the tube until the two elements can be welded together.

5. A handle for a broom or mop or the like comprising:

an elongated tubular handle formed of 20 gauge steel and having an outside diameter of about 13/16 inch, the handle having an open outer end, the handle further having a vinyl sleeve on the exterior surface thereof;

a steel plug mounted in the open outer end of the handle and projecting out of the handle, the plug having a modified Acme external thread such that the plug can screw into the threaded internal opening in a conventional push broom head, the external threads extending into the interior of the tube, the plug further having a threaded internal opening in the outer end of the plug, such that the handle can be screwed on a conventional threaded handle attachment stud on a metal mop frame, the plug having an outside diameter of about 0.750 inches; and the handle being attached to the plug by being crimped over the plug so as to project inwardly between the threads of the plug, the crimped portions of the handle being spot welded to the plug.

6. A handle for a broom or mop or the like comprising:

an elongated tubular handle formed of weldable metal and having an open outer end;

a weldable metal plug mounted in the open outer end of the handle and projecting out of the handle, the plug having an external thread such that the plug can screw into the threaded internal opening in a conventional push broom head, the external threads extending into the interior of the tube, the plug having an outside diameter slightly less than the inside diameter of the handle; and the handle being attached to the plug by being crimped over the plug so as to project inwardly between the threads of the plug, the crimped portions of the handle being spot welded to the plug.

7. A handle for a broom or mop or the like comprising:

an elongated tubular steel handle having an open outer end, the handle further having a vinyl sleeve on the exterior surface thereof;

a steel plug mounted in the open outer end of the handle and projecting out of the handle, the plug having a modified Acme external thread such that the plug can screw into the threaded internal opening in a conventional push broom head, the external threads extending into the interior of the tube, the plug further having a threaded internal opening in the outer end of the plug, such that the handle can be screwed on a conventional threaded handle attachment stud on a metal mop frame, the plug having an outside diameter slightly smaller than the inside diameter of the tubular handle; and the handle being attached to the plug by being crimped over the plug so as to project inwardly between the threads of the plug, the crimped portions of the handle being spot welded to the plug.

8. A handle for a broom or mop or the like comprising:

an elongated tubular metal handle having an open outer end; and a metal plug mounted securely in the open outer end of the handle and projecting out of the handle, the plug having an external thread such that the plug can screw into the threaded internal opening in a conventional push broom head, the external threads extending into the interior of the tube, the plug having an outside diameter slightly smaller than the inside diameter of the tubular handle, the handle being attached to the plug by being crimped over the plug, the crimped portions of the handle being spot welded to the plug.

9. A method for manufacturing a handle for a push broom or mop or the like, wherein a threaded metal plug is mounted in the open end of a tubular metal handle comprising the steps of:

forming the metal plug with threads that fit the interior threaded opening in a conventional push broom, the threads being formed a sufficient distance along the plug such that the threads can fit in the inside of the tube and still extend out of the tube for attachment to a broom, the metal plug being formed such that it fits easily into the end of the tube;

fitting the plug into the end of the tube such that a portion of the threads lies inside the tube and a portion of the threads protrudes out of the tube;

crimping the end of the handle over the plug at a plurality of positions around the handle, the crimping being performed with a crimping tool that has a plurality of projections thereon that engage the wall of the tube and cause it to be deformed inwardly between the threads of the plug as the wall of the tube is pressed against the plug, such crimping holding the plug in the tube until the two parts can be welded together; and spot welding the tube to the plug at the points where the tube is crimped into contact with the plug.

* * * * *